US006336541B1

(12) United States Patent
Belfiore et al.

(10) Patent No.: US 6,336,541 B1
(45) Date of Patent: Jan. 8, 2002

(54) ACTUATION DEVICE HAVING IMPROVED WORKING SPEED

(75) Inventors: Stefano Belfiore, Borgo S. Martino; Fiorenzo Pivetta, Casale Monferrato, both of (IT)

(73) Assignee: Eltek S.p.A., Casale Monferrato (IT)

( * ) Notice: Subject to any disclaimer, the term of this patent is extended or adjusted under 35 U.S.C. 154(b) by 0 days.

(21) Appl. No.: 09/479,289

(22) Filed: Jan. 6, 2000

(30) Foreign Application Priority Data

Jan. 8, 1999 (IT) ..... TO99A000005

(51) Int. Cl.[7] ..... D06F 37/42; F16P 3/00
(52) U.S. Cl. ..... 192/116.5; 60/523
(58) Field of Search ..... 192/116.5, 148; 68/23 R, 12.02, 12.24; 60/523, 527; 337/388, 390, 55, 131; 74/97.1, 615; 188/69

(56) References Cited

U.S. PATENT DOCUMENTS 1,832,090 A * 11/1931 Branche ..... 60/523 X
3,686,857 A * 8/1972 Berg ..... 60/526
3,782,121 A * 1/1974 Marcoux et al. ..... 60/527
4,070,859 A * 1/1978 Sobecks ..... 60/530
4,887,429 A * 12/1989 Birli et al. ..... 60/527
5,267,456 A * 12/1993 Nukaga et al. ..... 68/12.24
6,121,588 A * 9/2000 Cerruti ..... 60/527 X

* cited by examiner

*Primary Examiner*—Rodney H. Bonck
(74) *Attorney, Agent, or Firm*—Levine & Mandelbaum

(57) ABSTRACT

An actuation device is described, having:

an actuator with a movable actuation element;

at least a transmission element being capable of moving from a respective first operating condition to a respective second operating condition under the action of the actuation element. According to the invention, a hooking-release arrangement is provided, which is made operative by the actuation element during a displacement of the latter, for inducing in the transmission element a movement which occurs at least in part with a speed being higher than the speed of the displacement of the actuation element. The device has an advantageous use in the realization of systems for blocking, in a predetermined position, the drum of a machine for washing and/or drying laundry.

46 Claims, 8 Drawing Sheets

FIG. 7
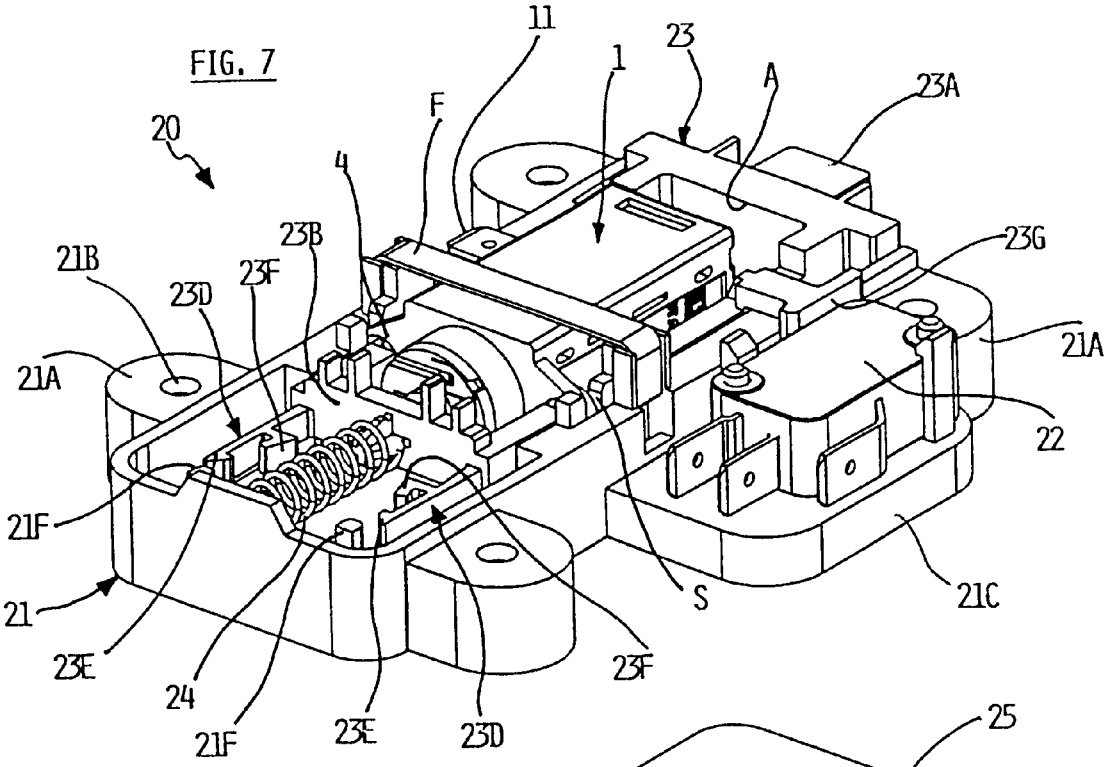
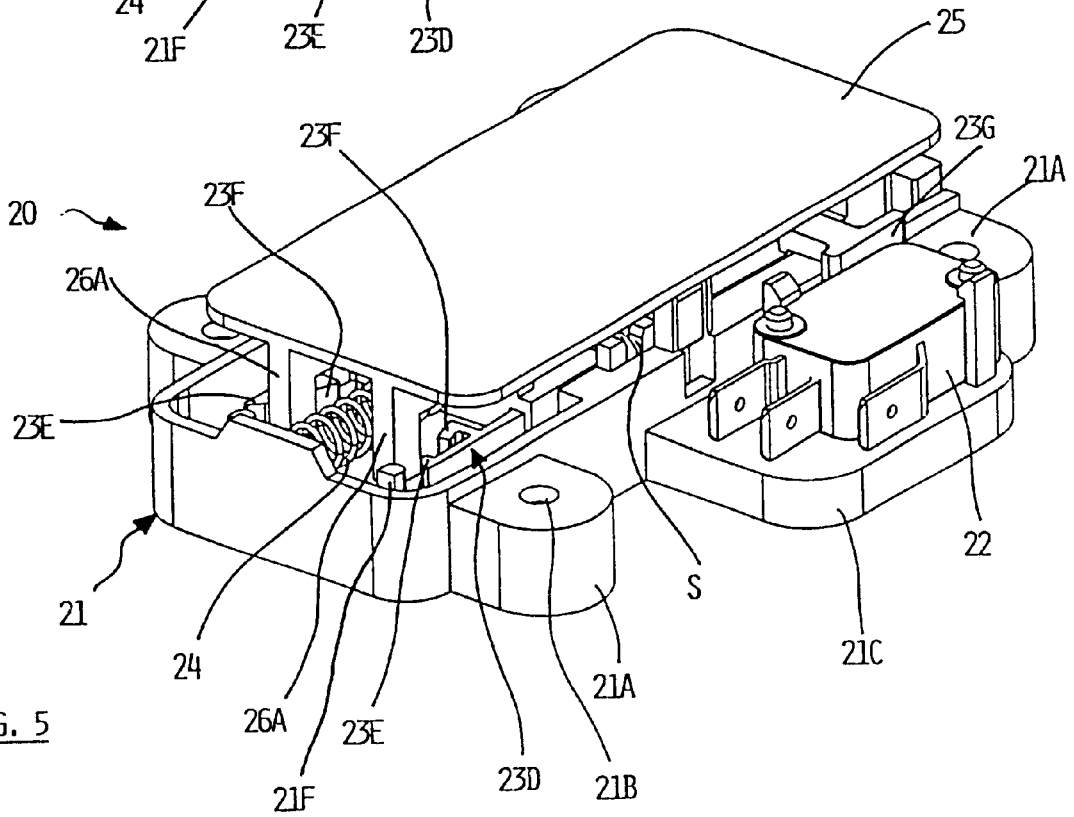
FIG. 5

FIG. 15
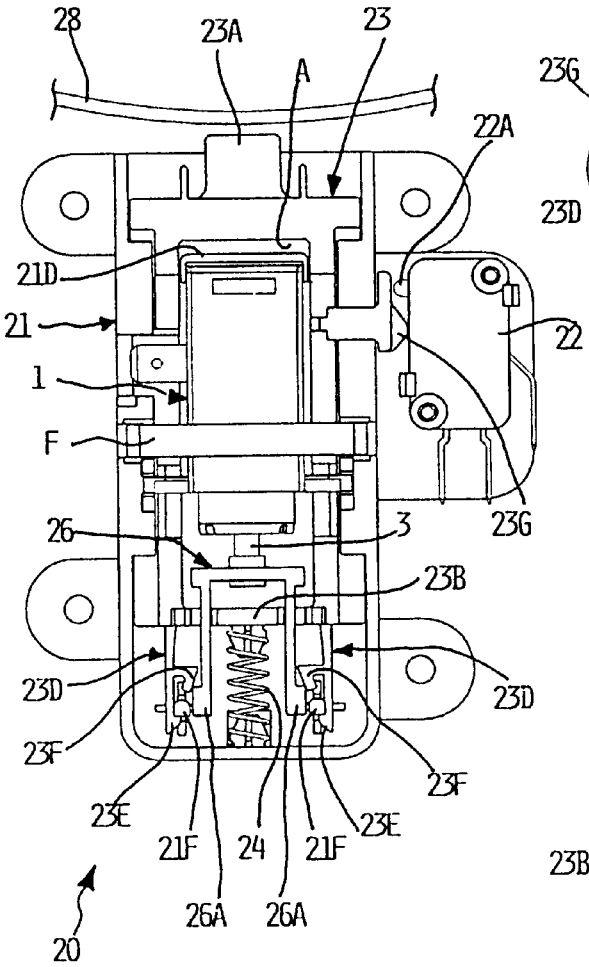
FIG. 16
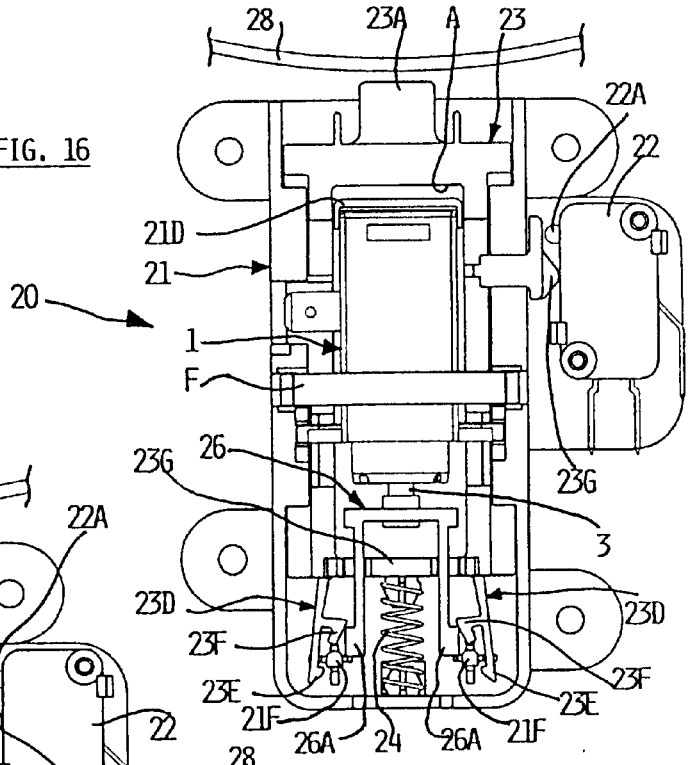
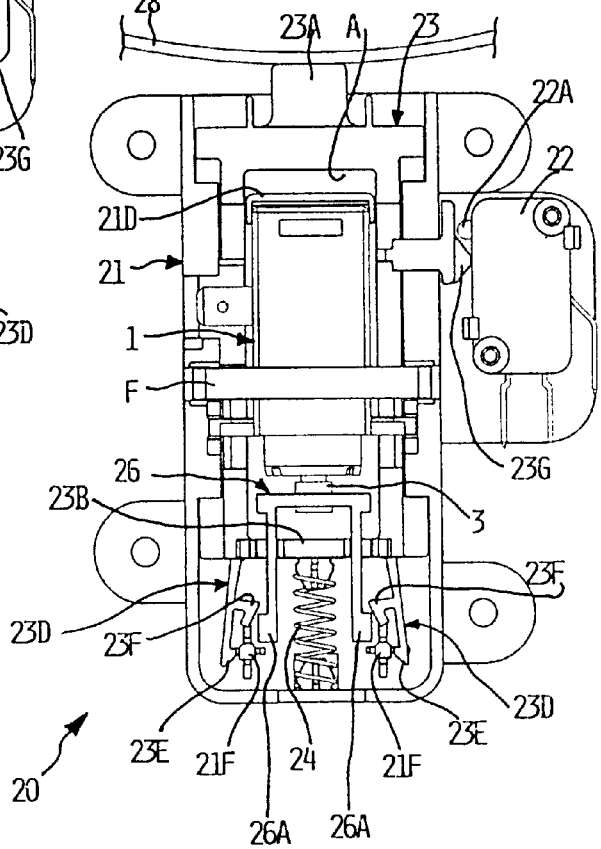
FIG. 17

ACTUATION DEVICE HAVING IMPROVED WORKING SPEED

BACKGROUND OF THE INVENTION

The present invention refers to an actuation device, and to a system for blocking, in a predetermined position, the drum of a machine for washing and/or drying laundry, using such an actuation device.

Actuation devices of the above type are generally known and used in several fields; they usually consist of an actuator having at least an actuation element, movable between at least a respective first position and a respective second position, and vice-versa, and a transmission element capable of moving from a respective first operating condition to a respective second operating condition, under the action of said actuation element.

Among the actuation devices of the cited type, those using a thermal actuator have, for instance, a significant importance, by virtue of their simple and economical manufacture, and their high reliability. Their further advantages are constituted the notable power they can develop, in view of their contained dimensions, and, above all, their operating noiselessly.

Thermal actuators, also known as thermo-actuators, usually have a housing made of a thermal conductive material (for example metal), which is connected to an electric heater. Within the housing, there are contained a thermally expansible material (such as a wax) and a piston which constitutes the actuation element; the electric heater is usually a positive temperature coefficient resistor, or PTC, which is electrically supplied through two terminals.

When a voltage is applied to the supply terminals, current passes through the electric heater, so that the latter generates heat and causes expansion of the thermally expansible material. The expansion, in turn, causes linear displacement of the piston, towards the outside of the housing, until a predetermined position, usually set through a mechanical end-of-stroke, is attained, which can be defined as a final working position.

Upon interruption of the electric supply, the heater and housing of the thermo-actuator cool down, and the thermally expansible material shrinks, thereby causing the piston to return to the initial rest position, with the aid of a return elastic element, such as a spring.

One of the peculiar features of thermal actuators, or thermo-actuators is their working slowness, which is determined by the necessary times for heating and cooling the thermally expansible material, with the relevant expansion or shrinking, and resulting piston movement.

As said above, this fact does not limit the use of thermal actuators in a wide range of fields, where the operating speed of the device is not crucial, either during the electric supply phase or during the return phase to the initial rest position.

Similar considerations can also be made in connection with other type of actuators, which are characterized by a certain slowness in movement during return to the initial rest position, such as for instance those based on the use of electric motors and/or gear-reducers, which operate rotating cams having a shaped profile.

For some applications, however, it is convenient to have an actuation device based on the use of a thermo-actuator which, during at least one of its operating phases, is able to produce movement faster than that imposed by the simple heating or cooling speed, and resulting expansion or shrinking, of the thermally expansible material. Similarly, in the case of an actuation device based on an electric motor and/or a gear-reducer, which rotates a shaped profile cam, it could be convenient to have movement of the cam towards a respective operating condition which is faster than that imposed by the simple speed of angular movement of the motor which operates the cam.

SUMMARY OF THE INVENTION

The present invention is based on the acknowledgment of the above facts and, within such a framework, has the purpose of providing an actuation device which, at least during a respective operating phase, can produce movements that are faster than those imposed by the actuation times and/or the intrinsic speed of the relevant actuation means, the faster movements being, in particular, obtained in a terminal period of the operating phase of the actuation means.

A further aim of the invention is that of providing an actuation device which is capable of realizing at least a type of actuation which is delayed with respect to the instant when the actuator of the actuation device starts to move towards one of its possible end-of-stroke conditions.

A further aim of the invention is that of providing a system for blocking, in a predetermined position, the drum of a machine for washing and/or drying laundry, using such an actuation device.

The foregoing aims are attained, according to the present invention, by an actuation device and a system for blocking, in a predetermined position, the drum of a machine for washing and/or drying laundry, having the features of the annexed claims, which form an integral part of the present description.

Further aims, features and advantages of the present invention will be apparent from the following detailed description and the annexed drawings, which are supplied purely as a non limiting example.

DESCRIPTION OF THE DRAWINGS

FIGS. 5 and 6 are two perspective views, according to different orientations, of an actuation device according to the present invention;

FIGS. 7 and 8 are two perspective views, according to different orientations, of an actuation device according to the present invention, without a covering and/or actuation element;

FIGS. 12 to 17 schematically represent, in section, the actuation device of the previous figures, under six different operating conditions, with reference to a specific example of use of the present invention.

DESCRIPTION OF THE PREFERRED EMBODIMENT

Figure 1:
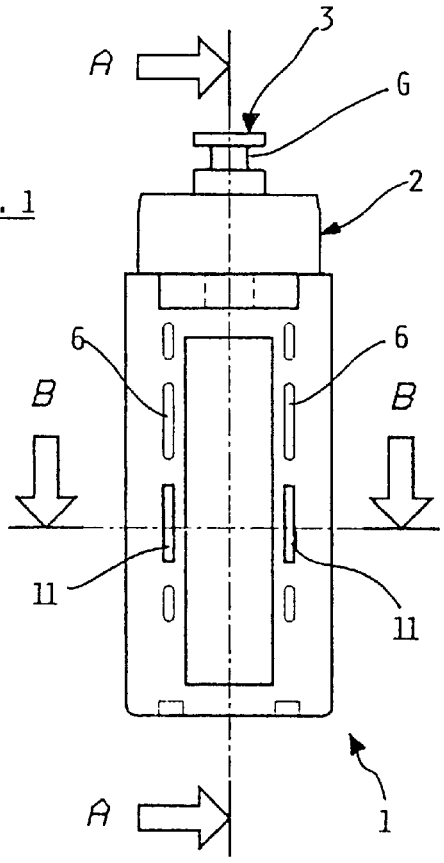
FIG. 1 is a side view of an actuator of the thermal type being part of the actuation device according to the present invention.

FIGS. 1–4 represent an actuation apparatus of the thermal type, being of substantially known construction; it should be considered that actuation apparatuses of the type being represented in the above figures are standardized components, and widely used in several fields, such as for instance automotive, household appliances, air conditioning, etc.

The thermal actuation apparatus 1, has an external housing 2, preferably obtained through the mutual coupling of two half-shells 2A and 2B made of thermoplastic material; the housing 2 has, at one of its lengthwise ends (in the illustrated case the upper end), an aperture, from which a portion of an actuating shaft 3 protrudes; two wings 4 of the housing 2 are used for anchoring the latter to a fixed part of the device on which the thermal actuation apparatus 1 is used.

Side apertures 6 of the housing 2 are provided for allowing air circulation, in order to speed up the cooling phase of internal components of the thermal actuation apparatus 1.

Figure 3:
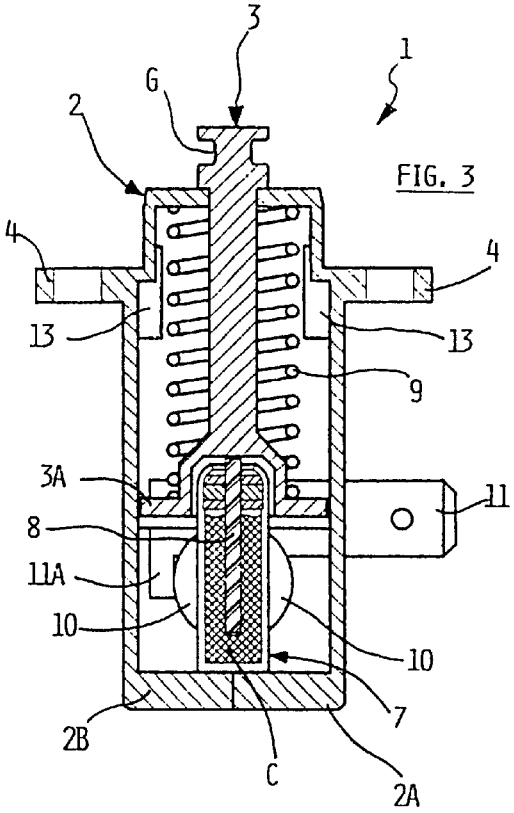
FIG. 3 is a sectional view of the actuator according to axis A—A of FIG. 1.
Figure 2:
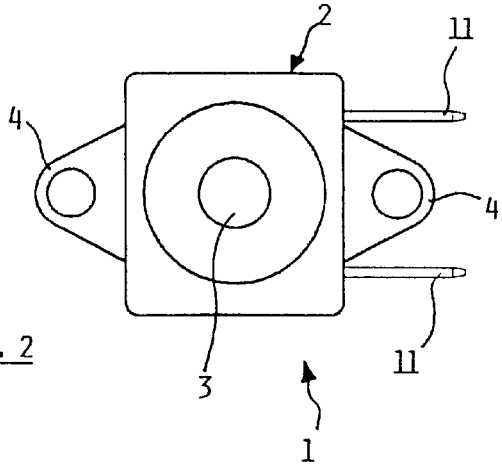
FIG. 2 is a plan view of the thermal actuator of FIG. 1.
Figure 4:
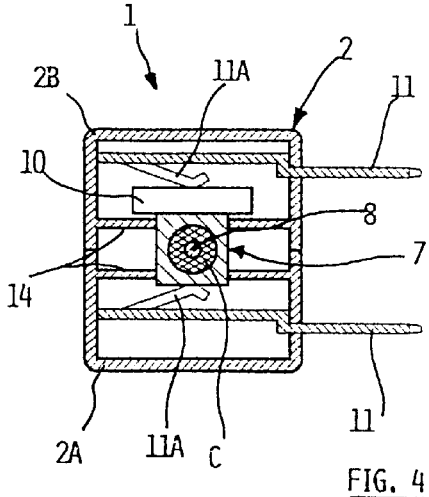
FIG. 4 is a sectional view of the actuator according to axis B—B of FIG. 1.
Figure 8:
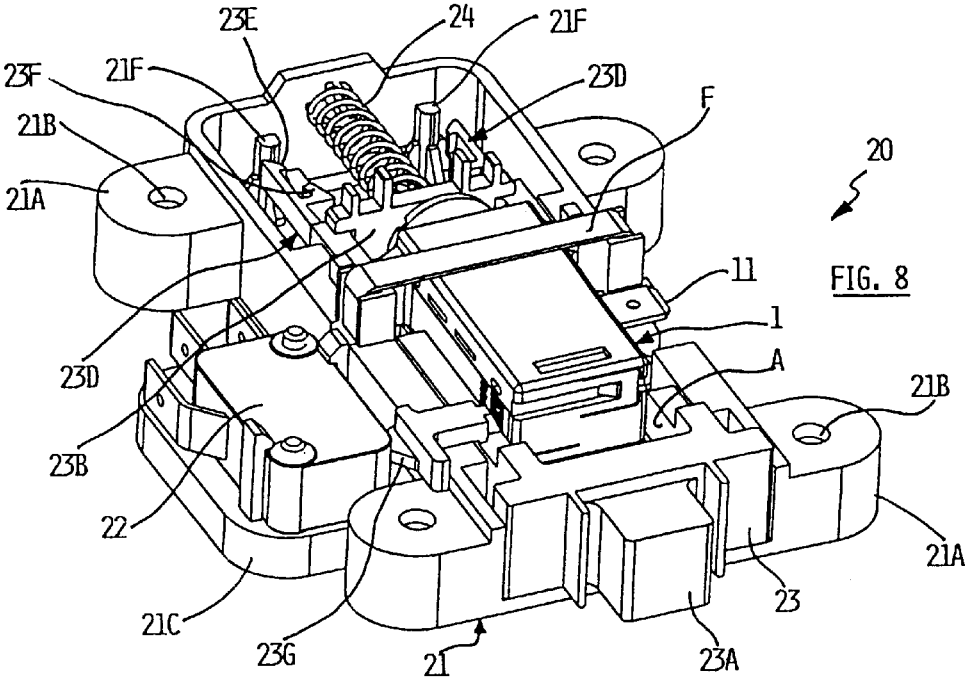
Figure 6:
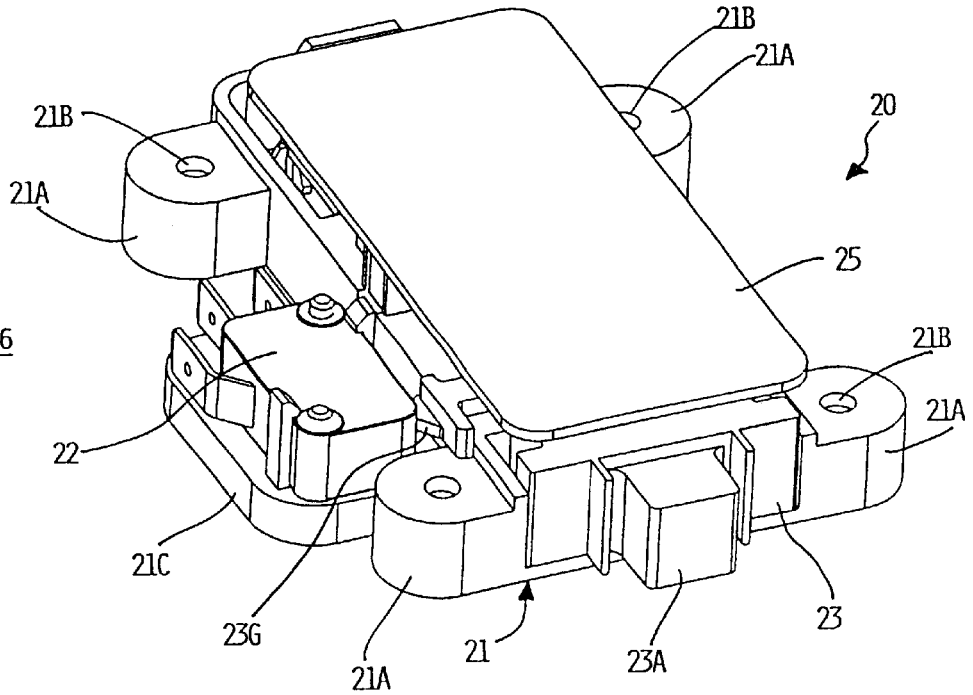

Within the housing 2 a thermo-actuator thermo-actuator 7 is arranged, being of the usual type and also known as a thermal head,; the thermo-actuator 7 is equipped with a relevant thrust element or small piston 8; one end of the piston 8 is arranged within the body of the thermo-actuator 7, and dipped in a thermally expansible material, such as a wax C as indicated in FIGS. 3 and 4; the other end of the piston 8 protrudes from the body of the thermo-actuator 7, for pushing on the actuating shaft 3; thermo-actuators of the type indicated with 7 are widely known.

The thermo-actuator 7 is made integral, in a known manner, with the housing 2, within which the shaft 3 is at least partly housed.

The shaft 3 is movable under the action of the piston 8 against the action of a spring 9; such a spring 9 is arranged within the housing 2, between the upper part of the latter and a widening 3A of the shaft 3; as can be seen, an end of the shaft 3 contacts the piston 8, while the opposite end protrudes from the upper aperture of the housing 2.

Reference number 10 indicates a heating element for the thermo-actuator 7, such as a positive temperature coefficient thermistor or PTC, and reference number 11 indicates the respective electric supply terminals. As can be seen, each of the terminals 11 has a portion which is contained within the housing 2; the internal portions of the terminals 11 are equipped with respective leaves 11A for contact with the heating element 10 and the body of the thermo-actuator 7, the latter being made of an electrically and thermally conductive material; in this way, an electric connection is made between the terminals 11, the thermo actuator 7 and the heating element.

Reference number 13 indicates strikers, being defined in the inner upper part of the housing 2, whose function is that of serving as mechanical end-of-stroke elements for the movement of the shaft 3. Reference number 14 indicates supports, made of the same plastic material as the housing 2, and having the function of defining a positioning seat for the thermo-actuator 7.

When terminals 11 are electrically energized, the heating element 10 generates heat, which is transferred to the body of the thermo-actuator 7, so as to cause the expansion of a thermally expansible material, usually a wax C as shown in FIGS. 3 and 4, contained within the same body. The expansion causes a linear displacement of the piston 8, which continues until the widening 3A of the shaft 3 reaches the strikers 13; in other words, the thermo-actuator 7 causes a change in the relative position between the shaft 3 and the housing 2.

When the electric supply to terminals 11 is interrupted, the heating element 10 cools down, with the subsequent progressive shrinking of the thermally expansible material C, and the piston 8 and the shaft 3 return to their initial rest positions, due to the action of the spring 9.

As can be seen, the thermal actuation apparatus 1 is equipped with an actuation member (which in the example is constituted by the piston 8 and the shaft 3), which is movable at least between a respective first position and a respective second position, and vice-versa.

Thermal actuation apparatuses are known, in which the thrust produced by the piston is used for generating traction movement for an actuating shaft; according to these solutions, the piston of the thermo-actuator moves in an opposite direction with respect to the case of FIGS. 1–4, i.e. for pulling the actuating shaft towards the inside of the housing 2, against the action of a spring.

FIGS. 5–11 represent, through different views, the actuation device according to the present invention, which contains the actuation apparatus 1.

The actuation device 20 has a main body 21, for example made of thermoplastic material, which is open at the top and comprises four flanges 21A, having respective holes 21B for screws; as can be seen in the figures, the body 21 can have a side appendage 21C, for anchoring a sensor 22, of known type, such as an electric micro-switch.

Figure 10:
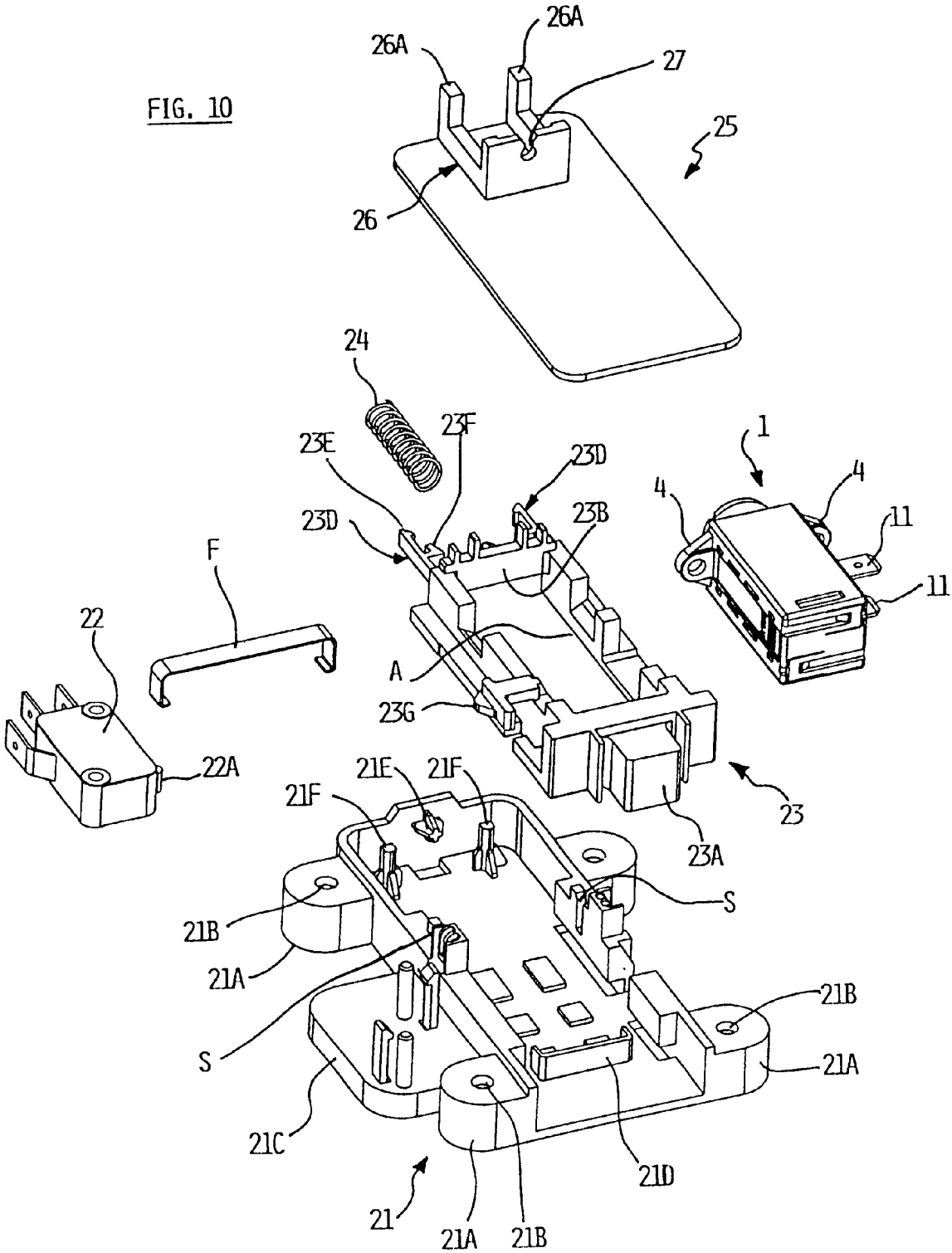
FIGS. 10 and 11 are two exploded views, according to different orientations, of the actuation device of FIGS. 5–9.
Figure 11:
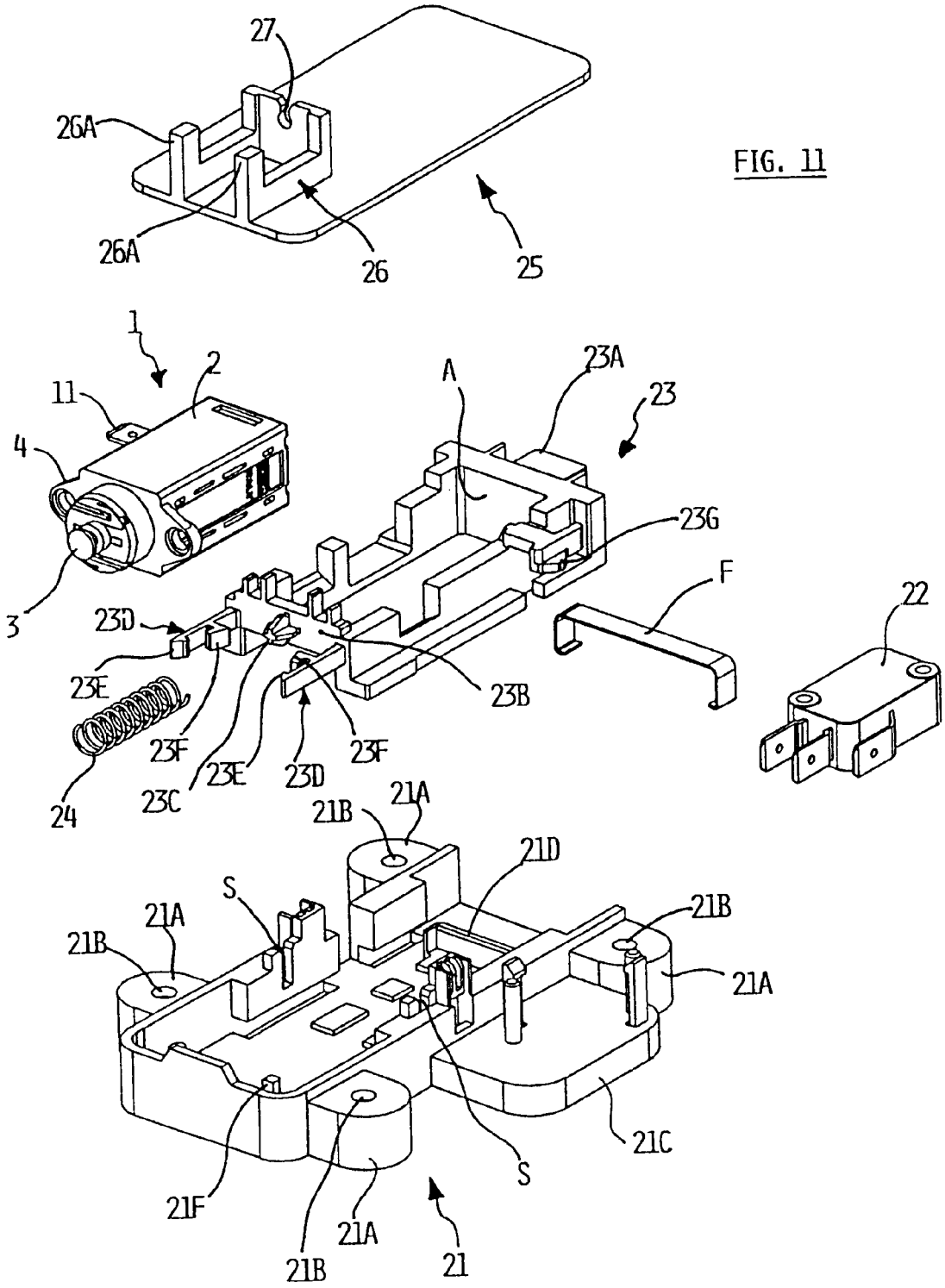

23 indicates a slide, movable within the body 21 and having an end appendage 23A, which protrudes through an aperture defined in one of the lengthwise ends of the body 21; 24 indicates an elastic or resilient element, such as a spiral spring, which operates between the slide 23 and the body 21; 25 indicates an upper cover and 26 indicates a slider; from FIGS. 10 and 11, where the cover is shown in an overturned position for ease of representation, it can be seen how in the given example the slider 26 is integral with the cover 26.

The section shown in FIG. 9 allows for clearly viewing the positioning of some of the components of the actuation device 20, which are hereinafter described.

Figure 9:
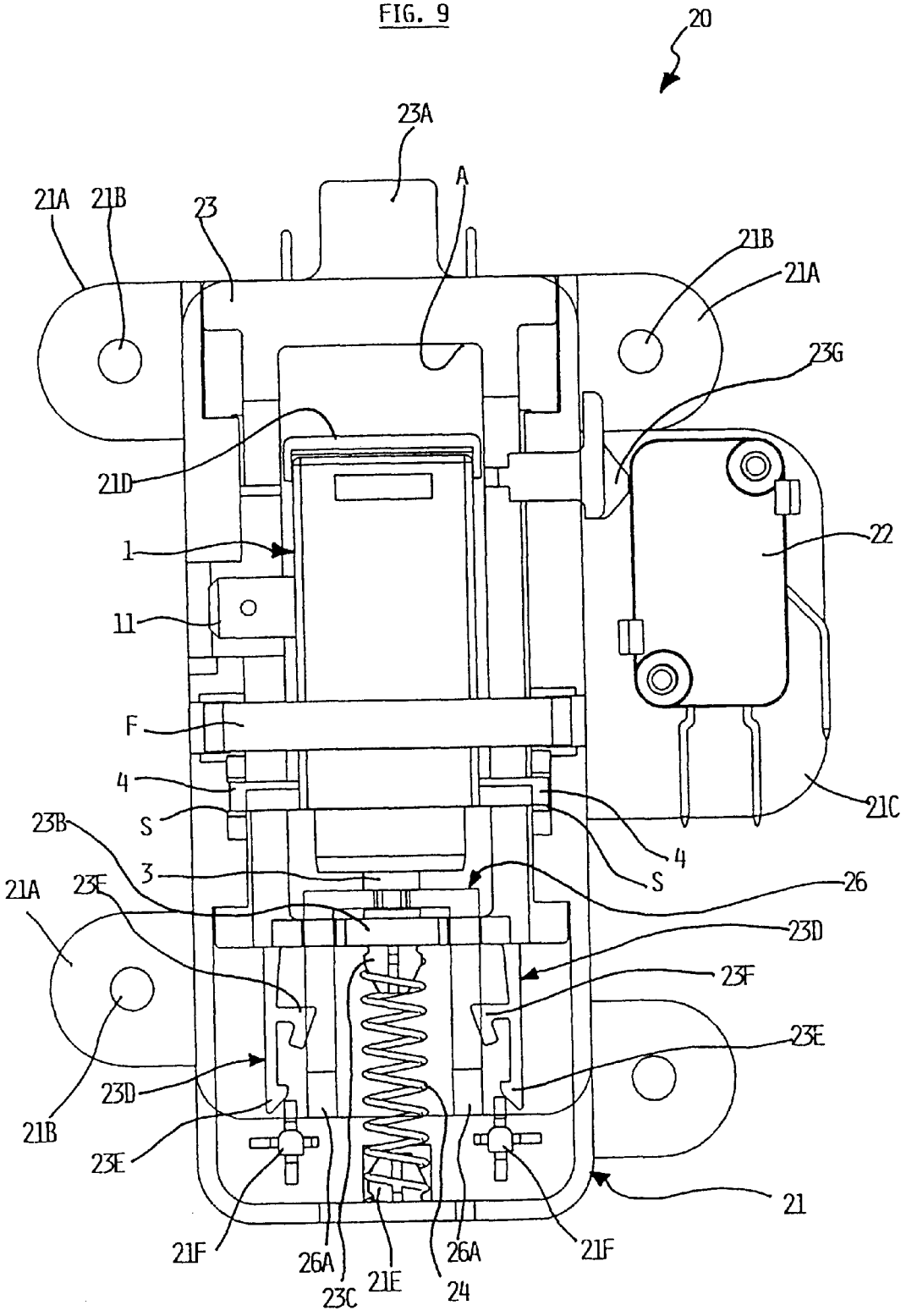
FIG. 9 is a sectional view of the actuation device of FIGS. 5–8.

As can be seen, the actuation apparatus 1 is present within the body 21, whose wings 4 are inserted into respective seats S defined in the same body 21; the maintenance of the correct position of the actuation apparatus 1 within the body 21 is further assured by means of strikers, one of which is indicated with 21D in FIG. 9; in addition, a device is provided for further assuring a fixed relative position between the actuation apparatus 1 and the body 21; in the example given in the figures, such a device is constituted by at least an elastic band F.

23 indicates as a whole the above mentioned slide; said slide is configured so as to have a central through cavity A, whose dimensions are greater than the encumbrance of the housing 2 of the actuation apparatus 1; the slide 23 is movable within the body 21 under the terminals 11 of the actuation apparatus 1; the actuation apparatus 1, the slide 23 and the cavity A are arranged and configured so that the slide 23 is capable of moving with respect to the actuation apparatus 1, the terminals 11 providing no obstacles to the movement.

A first end of the slide 23 defines appendage 23A which, as said above, passes through an aperture present in one of the lengthwise ends of the body 21.

The second end of the slide 23 has, on the contrary, a bridge 23B onto which an end of the shaft 3 of the actuation apparatus 1 can push; in the central part of the bridge 23B a constraint point 23C is present, for the spiral spring 24; the other end of the spring 24 is constrained at a point 21E which is defined on the lengthwise wall of the body 21 being opposed to that from which the appendage 23A protrudes.

A hooking device for the slide 23 also extends from the bridge 23B, laterally with respect to the constraint point 23C; in the given example, the hooking device 23 being constituted by two flexible foils 23D, whose ends are shaped for defining respective hooking teeth 23E, i.e. having an inclined surface which ends with a step.

At an intermediate point of the foils 23D reliefs 23F are also defined, whose function will be described in the following; as it can be seen, each of the reliefs 23F has at least an inclined lateral surface, or anyway shaped for allowing an easy sliding onto it of a surface of a further functional component of the actuation device according to the present invention (as will be clear in the following, the further functional component being realized by the slider 26, which has projections 26A designed for sliding on the reliefs 23F).

21F indicates hooking pins, which extend upwards from the bottom wall of the body 21; the pins 21F are substantially aligned with the foils 23D, substantially in line with the inclined surface of the hooking teeth 23E; as can be seen, the surface of pins 21F facing the foils 23D is substantially rounded or inclined, and in any case suitable for easing the sliding onto it of the inclined surface of the hooking teeth 23E, when the teeth have to overcome the constraint presented by pins 21F; the surface of pins 21F opposed to the foils 23D is, on the contrary, substantially flat.

As will be clear in the following, teeth 23E of the slide 23 are capable of hooking on pins 21F of the body 21.

23G indicates a lateral appendage of the slide 23, which protrudes from a side wall of the body 21, through an aperture of the latter; said lateral appendage 23G is provided for determining the switching of the micro-switch 22, namely by operating on an actuation element of the same micro-switch, indicated with 22A in FIGS. 10 and 13–17.

26 indicates the above mentioned slider, which is integral with the lower surface of the cover 25; the slider 26 is mechanically coupled with the shaft 3 of the actuation apparatus 1; to this purpose, in particular, a throat 27 of the slider 26 (FIGS. 10 and 11) results in being inserted on a narrowing (indicated with G in FIGS. 1 and 2) of the end of the shaft 3.

The slider 26, being integral with the cover 25, is arranged within the body 21 at a height level above the slide 23, i.e. it lies substantially above the bridge 23B; in general terms, therefore, the slider 26 and the cover 25 are not constrained with respect to the slide 23 and are free to move with respect to the latter.

In its lower part, i.e. the part facing the bottom wall of the body 21, the slider 26 define two lateral projections 26A, which can be seen in the section of FIG. 9 and in the views of FIGS. 5, 10 and 11, which in use result in being substantially aligned with the inclined reliefs 23F of the elastic foils 23D; as it will be clear in the following, said lateral projections 26A of the slider 26 have the function of operating on the inclined reliefs 23F, for determining an opening bending of the elastic foils 23D such to cause the release of the teeth 23H from the pins 21F.

According to the invention, the cover 25 and the slider 26 can be formed by two distinct parts, the former being fixed to the body 21 and the latter being anyway free to move with the shaft 3.

The operation of the device according to the present invention will be described in the following with reference to a possible use, i.e. on top loading laundry washing and/or drying machines, for blocking the drum of the machine in a predetermined position; this example of use of the device 20 should not be considered as a limitation of the present invention, which is susceptible of use also in other fields.

For the given example of use, it is known that top loading laundry washing and/or drying machines usually have a drum for containing the items to be washed and/or dried, which is rotatable within a treatment chamber; the drum rotation is usually produced by an electric motor, through a belt which operates between a first pulley, being integral with the drum rotation axis, and a second pulley, integral with the electric motor shaft.

It is also known that, in machines of the above type, the drum is equipped with an aperture, for the loading and unloading of laundry, which is defined on the cylindrical wall of the drum and normally closed by one or more movable members; the cabinet of the machine has, in its upper part, an aperture, which can be closed by means of a door, which allows access from above to the washing chamber, and therefore to the drum; obviously, in order to proceed with the loading and unloading of the laundry from the machine, the aperture of the drum has to be placed substantially in alignment with the upper aperture of the cabinet.

To this purpose, devices are known which, in an automatic way or upon depression of a proper key, allow for realizing the desired positioning of the drum, at the end of a washing cycle of before the start of the same, without having to manually rotate the basket (see for instance EP-A-0 401 734 or FR-A-2.522.343); some of these devices are also equipped with devices for preventing the opening of the cabinet door of the machine, when the drum is still moving.

In the example which follows, the signal derived from the switching of the micro-switch 22 is used by the control system of the machine for interrupting the supply to the electric motor which causes the drum rotation, when the latter has reached the desired position.

Additionally, as will be clear from the following, the micro-switch 22 is also used for controlling the operation of an electric device capable of assuring the closure condition of the door of the machine, during conditions potentially dangerous for the user, i.e. when the drum is still rotating; also the devices, which are generally known as "door-locking devices" are per se known, and do not require here a detailed description.

Consequently, in the following example of use of the present invention, the actuation device 20 is provided for assuring the automatic positioning of the drum in the predetermined loading position, and the micro-switch 22, which is associated with the actuation device 20, is arranged for interrupting the electric supply to the motor and to the door-locking device of the machine, and therefore allowing the opening of the door of the latter, when the drum has reached the predetermined position.

The operation of the device according to the present invention, in the non limiting example of use of a machine for washing and drying laundry, will be now described with reference to FIGS. 12–17.

In FIGS. 12–17, reference number 28 indicates a pulley, which is integral with the rotating shaft of the drum of the machine. In fact, as usual in laundry washing and/or drying machines, the drum revolution is caused by an electric motor, where a belt operates between the first pulley 28 integral with the drum, and a second pulley, integral with the shaft of the electric motor (some of the above components, such as the second pulley, the drum, the belt, the doorlocking device, the control system of the machine, are generally known and not represented in the figures for simplicity's sake).

Figure 12:
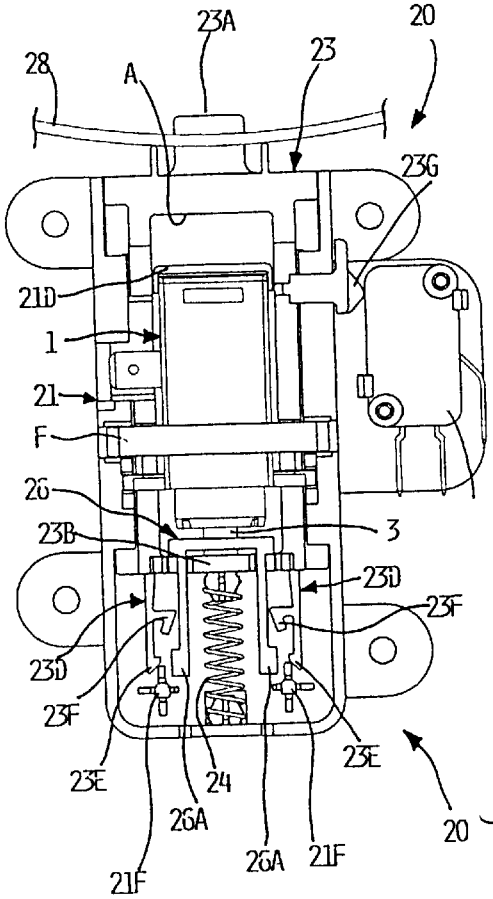

In FIG. 12 the starting rest position of the device 20 is illustrated; in the case of the given example, this situation typically precedes the start of a washing cycle, or its end, i.e. the situation in which the drum of the machine is blocked by means of the device 20 in the desired position: In this condition, the actuation apparatus 1 is not electrically supplied; the piston 8 of the thermo actuator 7 and the shaft 3 are therefore completely back moved, by virtue of the action of the spring 9 within the body 2.

On the contrary, the action of the spring 24 maintains the slide 23 in a first position, where the appendage 23A results in being inserted in a suitable recess defined in the pulley 28; in this way, therefore, the drum of the machine is also mechanically blocked in a determined position, in which the aperture for accessing to the inside of the drum results in correspondence of the upper door of the laundry washer.

From FIG. 12 it can be seen how the hooking teeth 23E of the foils 23D are not engaged on the pins 21F and the slider 26, being restrained by the shaft 3 of the actuator 1, results in a first position, which is completely moved back towards the same actuation apparatus.

In this condition, the lateral appendage 23G of the slide 23 maintains the actuation element 22A of the micro-switch 22 pressed down, so maintaining the supply circuits of the motor of the machine and of the cited door-locking device open; the drum is therefore at still, the door of the machine can be opened and the laundry introduced in the drum (or possibly extracted from the latter).

Once the loading of the laundry to be washed and/or dried has been carried out, and following the closure of the drum and the machine doors, the washing cycle can be started.

The start of the washing cycle determines, under the control of a programming device or timer of the machine (not represented), the electric supply of the heater 10 being contained in the actuation apparatus 1.

The time required for the heating of the thermo actuator 7 is on the order of some tens of seconds. During that time the motor cannot be supplied (also because the micro-switch 22 has its electric contacts open) and the drum remains blocked, as shown in FIG. 12; heating occurs however in a space of time during which the drum revolution is not necessary: to this purpose, it should be noted that a washing cycle usually commences with a water supply from the mains, before starting the drum revolution, and that the heating necessary for the operation of the actuation apparatus 1 can therefore be obtained during such a phase. It also should be noted, at any rate, that even in the instance of a "cold" washing, the time necessary for charging the water in the washing chamber is of the same order of time necessary for the heating of the thermo-actuator 7.

As previously explained, the heating of the thermo-actuator 7 determines the expansion of the thermally expansible material contained therein, with the subsequent movement of the piston 8 and therefore of the shaft 3.

Figure 13:
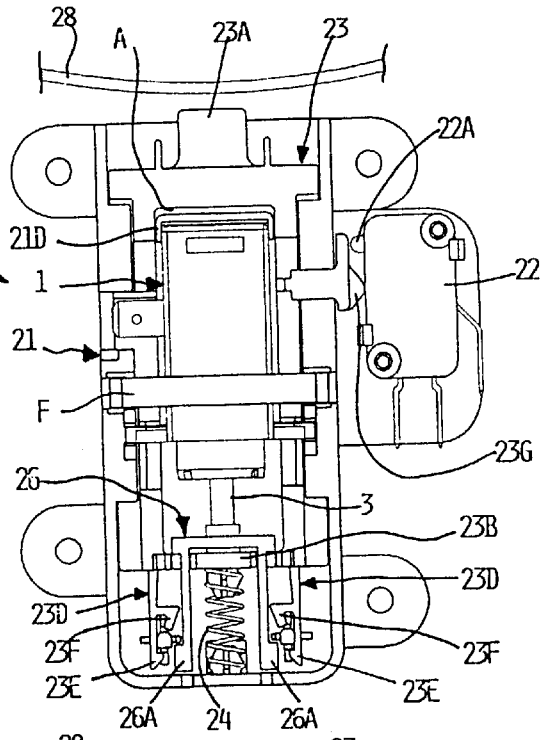

As shown in FIG. 13, the thrust produced by the shaft 3 on the bridge 23B of the slide 23 is such to win the force of the spring 24; the slide 23 is therefore displaced (downwards, with reference to the figures) and the appendage 23A of the same slide moves back within the body 21; consequently, the appendage 23A goes back also with respect to the recess of the pulley 28, so allowing the latter to rotate.

The movement of the slide 23 has also the effect of displacing the lateral appendage 23G, so freeing the actuation element 22A of the micro-switch 22; the switching of the micro-switch 22 is used by the control system of the machine as a criterion for enabling the start of the electric motor which produces the drum revolution; as said, said switching can also be used for closing the supply circuit of the door-locking device, which therefore provides for preventing the opening of the machine door.

By FIG. 13 it is also possible to notice how the shaft 3 determines a displacement of the slide 23 such that the teeth 23E of the foils 23D can overcome the pins 21F; this is allowed by virtue of the elasticity of the foils 23D, which are able to bend to the outside, and by the fact that during such a phase the inclined surface of the teeth 23E can slide onto the surface being shaped for such a purpose (rounded or inclined) of the pins 21F; when the entire inclined, or anyway shaped, surface of the teeth 23E overcomes the inclined surfaces of the teeth 21F, the elastic reaction causes the return of the foils 23D in the respective original position; the step of the teeth 23E are now aligned with the flat surface of the pins 21F, so resulting in an engagement of the teeth 23E with the pins 21F.

The movement of the shaft 3 of the actuation apparatus 1 determines in addition the movement of the slider 26, the latter being integral with the former by means of the throat G, and therefore of the cover 25, which moves forward in the same direction of movement of the slide 23.

The operating condition shown in FIG. 13, during which the actuation apparatus 1 is electrically supplied, is maintained for the whole actuation time provided for the device 20, i.e. in the given example, for the whole duration of the washing cycle.

In the last instants of the washing cycles, the timer of the machines provides for interrupting the electric supply to the actuation apparatus 1; in such a phase, the timer provides also for controlling the electric motor, so that the latter produces a slow revolution of the drum, in the order of 10–15 revolutions per minute.

The body of the thermo-actuator 7 starts to cool down, with the subsequent shrinking of the material C contained therein; the piston 8 and the shaft 3 can therefore slowly return towards the respective initial positions, with the aid of the spring 9 which is located within the actuation apparatus 1.

Since the contrary thrust produced by the shaft 3 is now lacking, also the spring 24 tends to push the slide 23 towards the initial position.

Figure 14:
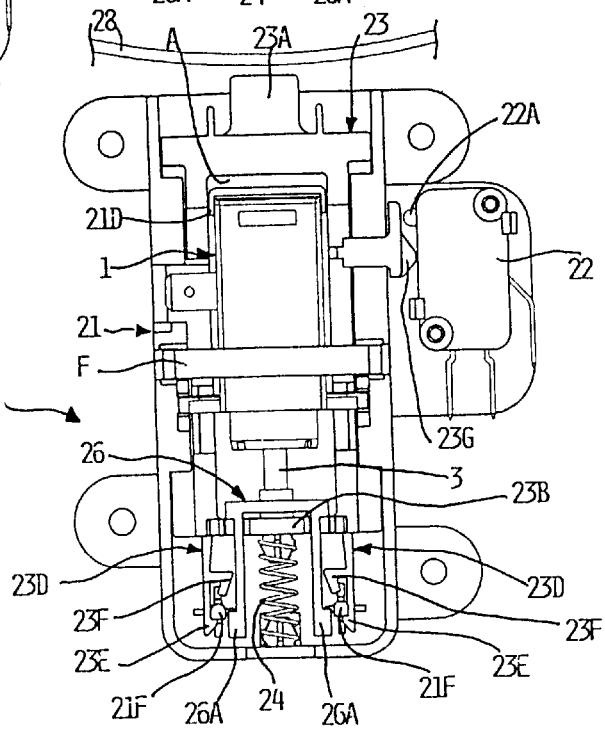

As it can be seen in FIG. 14, however, said movement of the slide 23 is stopped when the steps of the hooking teeth 23E come into contact with the flat surfaces of the pins 21F; in other words, shortly afterwards the start of the return of the slide 23 towards the initial position, the latter is blocked by means of the teeth 23E which engage with the pins 21F.

The micro-switch 22 is therefore maintained in the position of closure of the supply circuit of the doorlocking device, so preventing the opening of the door; otherwise, risks could exist for the user which opens the door of the machine during such a phase, said risks deriving from the anyway slow rotation of the drum.

On the other hand, the shaft 3 is free to prosecute in its movement for going back within the body 2 of the actuation apparatus 1, as shown in FIG. 15.

From said FIG. 15 it can be noticed how such a return of the shaft 3 also determines the progressive backing of the slider 26, during which the lateral projections 26A of the same slider come into rest on the inclined reliefs 23F of the foils 23D.

Since the action of the spring 9 has a force such to win the elasticity of the foils 23D, the sliding of the lateral projections 26A of the slider 26 on the inclined surfaces of the reliefs 23F determines the progressive bending or mutual widening of the same foils 23D; said bending increases while the shaft 3, and hence the slider 26, return towards the respective rest position.

As shown in FIG. 16, upon reaching of a determined bending value of the foils 23D, the teeth 23E release themselves from the pins 21F, the steps of the teeth disengaging from the flat surfaces of the pins.

The slide 23 is therefore released, with the consequence that the action of the spring 24 determines a sudden movement of the slide 23 towards the respective original position; as it can be seen in FIG. 17, the appendage 23A of the slide 23 is therefore pressed on the pulley 28, with the spring 24 which still remains partly loaded.

It has to be underlined how, in the illustrated example, the foils 23D, with the relevant teeth 23E and reliefs 23F, the pins 21F, and the slider 26 with the relevant projections 26A, are dimensioned so that the release of the teeth 23E from the pins 21F occurs when the shaft 3 is practically gone back in the respective initial rest position, following the complete shrinking of the thermally expansible material, and by virtue of the action of the internal spring 9 of the actuation apparatus 1; in the given example, the stroke of the slider 26 is greater than the useful stroke of the elastic foils 23D.

During such a phase, the slow revolution of the drum can proceed, by winning the braking action of the appendage 23A on the pulley 28, until the cited recess defined in the latter comes in correspondence of the appendage 23A.

In such an instant, the spring 24 determines the last movement of the slide 23, with the sure insertion of the appendage 23A into the said recess, so causing the blocking of the movement of the pulley 28 and the drum associated with it; the device 1 therefore returns in the position of FIG. 12 and the drum results in being blocked in the position where its loading aperture is found in correspondence of the door of the machine.

Following said last movement of the slide 23, also the switching of the micro-switch 22 is obtained, since the lateral appendage 23G newly presses down the actuation element 22A; the switching of the micro-switch 22 is used by the control system of the machine for interrupting the supply to the electric motor which produces the drum revolution, and the supply circuit of the door-locking device is opened.

At this point, the drum is therefore blocked in the desired position, the motor is at still and the machine door can be opened.

From the above, it results therefore clear how the device according to the present invention allows for obtaining, through a single thermal actuator and during a respective operating phase (i.e. the return phase to the rest condition), a movement being faster than that which would be imposed by the mere cooling, and therefore shrinking, speed of the thermally expansible material C.

It has to be noticed that, contrary to the system being exemplified according to the present invention, a slow a progressive movement of a blocking element (as the appendage 23 is) of the pulley, i.e. determined solely by the shrinking speed of a thermally expansible material, could cause malfunctioning and breaking risks of the blocking element; this would be due to the initial insertion, minimal and partial, of the blocking element into the recess of the pulley during the revolution of the latter, which is however not sufficient for stopping the same.

As previously explained, the actuation device 20 according to the invention is not intended for the limited application in the field of washing machines, since the same is susceptible of use in all cases where it is useful to have an actuation device which, at least during a respective operating phase, can produce movements faster than the movements imposed by the actuation times and/or the intrinsic speed of the relevant actuation means.

Obviously, for said different applications, the micro-switch 22 could be not required, or the same could be used as a simple sensor means of the operating condition of the device 20.

According to a possible alternative embodiment of the invention, the actuation device could be conceived for realizing the release of the slide 23 in an inverse manner, with respect to the above described one, i.e. during a supply phase of the of the actuation apparatus 1. This can be obtained, for example, by turning over the position and the direction of movement of the actuation apparatus 1 and the slider 26, so that:

- the shaft 3 pushes, when the actuation apparatus 1 is supplied, the slider 26 in a direction opposed with respect to the previously described one, but without operating on the slide 23;
- the slide 23 is pushed towards its working position only by means of the spring 24, and in an opposite direction by the internal spring of the actuation apparatus 1.

In such a case, therefore, the operation of the actuation device according to the invention would be the following:

- in the rest position of the device 20, the slide 23 results in being engaged by means of the teeth 23E and the pins 21F, as previously described;
- following the supply to the actuation apparatus 1, the shaft 3 pushes the slider 26, for causing the bending of the foils 23D, until the release of the slide 23 is determined; the spring 24 therefore causes the fast movement of the slide 23 towards the respective working position;
- following the successive switching off of the actuation apparatus 1, the shaft 3, under the action of the internal spring 9 of the same actuation apparatus, brings the slider 26 back towards the respective starting position;
- at a given point of such a return movement of the slider 26, the same slider comes into contact with the slide 23, then dragging the latter towards the respective initial position, until a new engagement of the slide by means of the teeth 23E and the pins 21F is determined.

It is clear that, according to such an embodiment, the force of the spring 9 will have to be greater than the spring 24 and such of enabling the required bending of the foils 23D, in order to allow for the hooking of the slide 23 in its respective rest position.

The features of the present invention result in being clear from the given description. In particular, an actuation device has been described, comprising:

- an actuator 1, having a movable actuation element constituted by the shaft 3 and/or the small piston 8,
- at least a transmission element, constituted by the slide 23, capable of moving from a first operating condition (rest or work, respectively) to a second operating condition (work or rest, respectively) under the action of the actuation element 3.

According to the invention, the device provides for actuating means, comprising the components 21F, 23D, 24, 26, which are made operative by the actuation element 3 during a displacement of the latter, for inducing to the transmission element 23 a movement which occurs at least in part with a speed higher than the speed of said displacement of the actuation element 3.

From a different point of view of the invention, the device provides for actuating means, comprising the components 21F, 23D, 24, 26, which are made operative by the actuation element 3 during at least a part of an operating period of the latter, for inducing to the transmission element 23 a movement which is delayed with respect to said displacement of the actuation element 3.

The cited actuating means comprise:

hooking means 21F, 23D, for retaining the transmission element 23 in an operating condition, during at least a first part of the displacement of the actuation element 3; said hooking means 21F, 23D are capable of being released during at least a second part of the displacement of the actuation element 3;

elastic or resilient means 24, which are loaded by means of the transmission element 23, during the movement of the latter from the respective first operating condition to the respective second operating condition;

release means 23F, 26 which are made operative by the actuation element 3, for releasing the hooking means 21F, 23D during at least a second part of said displacement of the actuation element 3.

The hooking means 21F, 23D comprise first hooking means 23D and second hooking means 21F capable of mutual coupling during the movement of the transmission element 23 from the respective first operating condition to the respective second operating condition; the first hooking means 23D are flexible with respect to the second hooking means 21F, in order to obtain their mutual coupling.

To this purpose, a first bending of the first hooking means 23D is induced by the sliding of a first surface of the first hooking means 23D onto a first surface of the second hooking means 21F, wherein said first bending ends substantially upon the overcoming of the sliding of said first surface of the first hooking means 23D onto said first surface of the second hooking means 21F; at the end of the sliding of said first surface of the first hooking means 23D onto said first surface of the second hooking means 21F, the first hooking means are capable of returning towards the respective original position, wherein a second surface of the first hooking means 23D results in cooperating with a second surface of the second hooking means 21F.

The release means 23F, 26 comprise strikers 23F, for inducing a second bending of the first hooking means 23D with respect to the second hooking means 21F; the amplitude of said second bending is capable of determining the uncoupling of the first hooking means 23D with respect to the second hooking means 21F.

The release means 23F, 26 comprise also an element 26 which is associated with the actuation element 3 and movable with the latter; the movable element 26 is capable of operating the strikers 23F in order to produce the cited second bending of the first hooking means, during the displacement of the actuation element 3.

Transmission means can be connected to the actuation element 23, for carrying out a remote actuation.

The actuator 1 is preferably of the electro-thermal type, and comprises:

a container 7 for a thermally expansible material C;

a pushing element or small piston 8, one end of which is arranged within the container 7 and dipped into the thermally expansible material C, the other end of the pushing element 8 protruding out of said container 7;

means 10 for heating 10 the container 7, in order to cause an expansion of the thermally expansible material C.

The device according to the invention can be conceived so that the movement from a position to another of the actuation element 3 corresponds to the passage of the latter from a working position to a rest position or vice-versa, or corresponds to the passage from a supply cycle to a switching off cycle of the actuator, or vice-versa.

The described device can found a possible use for realizing the blocking in a determined position of the drum of a laundry washing and/or drying machine.

To this purpose, the transmission element 23 performs the function of blocking element, and has a portion 23A able to cooperate with a transmission member 28 of the motion to the drum.

Sensor means 22 can be advantageously provided, being actuated by the blocking element 23, for controlling the operation of an electric device provided for assuring the closure of the door of the machine and/or of a motor which produces the movement of the drum, or for other functions.

Transmissions means can also be connected to the blocking element, for controlling the operation of a mechanical device able to assure the closure of the door of the machine.

From the given description, also the advantages of the present invention are clear; in particular, the invention allows for realizing an actuation device which, at least during a respective operating phase, can produce movements faster than those imposed by the actuation times and/or the intrinsic speed of the relevant actuation means; from the above, it also results clear how, in different words, the actuation device is able to realize at least a first type of actuation which is delayed with respect to the moment when the actuator thereof starts moving towards one of its possible end-of-stroke conditions.

The device according to the invention is advantageously realized by simple and cheap components, notwithstanding the fact that it assures a notable reliability.

It is clear that several variants are possible for the man skilled in the art to the actuation device described by way of example, without departing from the novelty scope of the inventive idea.

With reference to the example of use as previously described, relating to the production of a device for blocking the drum of a laundry washing and/or drying machine, the possibility is cited of exploiting the movement of the slide 23 for realizing the control of a door-locking device being of mechanical actuation, instead of the electric one.

In particular, for such an application, the end of the slide 23 where the appendage 23A is located could be connected, through suitable transmission means, such as a cable, to a door-locking device comprising a hooking element, for instance of the angular movement type or the latch type, for retaining the door in a closed position.

According to the proposed variant embodiment, in the condition of FIG. 12, such a cable does not results under tension, so that the hooking element, forced by proper elastic means, does not block the door opening.

On the contrary, when the actuation apparatus 1 is supplied, and therefore the slide 23 moves as in FIG. 13, the cited cable is tensioned, so as to cause an angular movement of the hooking element, or a linear movement of the latch, so as to determine the locking of the door.

Only after the supply to the actuation apparatus 1 has been interrupted and following the insertion of the appendage 23A in the recess of the pulley 28 (i.e. the phase which follows in time that illustrated in FIG. 17), the tension of the cable will result sufficiently slackened for allowing the return of the hooking element or the latch in the respective initial position, which does not retain the door in the locked position.

According to said application, therefore, the micro-switch 22 might not be strictly necessary, inasmuch as the information necessary to the control system of the machine for interrupting the supply of the motor that moves the drum (i.e. the information that the drum has been blocked in the desired position) could be drawn from a tacho-meter or other sensor means of the speed of revolution of the drum.

It is however clear that, besides the given specific example, the actuation device 20 is able to realize either a direct and local action, by means of the appendage 23A of the slide 23, or a remote actuation, by means of suitable transmission means, such as the cited cable or other proper kinematic device, connected to the slide 23 and/or the slider 26.

According to a further possible variant, the foils 23D, with the relevant teeth 23E and reliefs 23F, the pins 21F, and the slider 26 with the relevant projections 26A, could be have dimensions, shapes and/or position different with respect to those illustrated by way of example, in order to obtain a movement of the slide 23 at different speed towards the respective initial position.

By means of said variations in dimensioning, shaping and positioning, it could be easily obtained:

- a first phase of slow movement of the slide 23, which would start at the moment of the interruption of the electric supply to the actuator 1; the speed of said phase would be determined by the sole cooling speed of the thermally expansible material and by the action of the internal spring 9 of the actuation apparatus 1; said phase would end when the steps of the teeth 23E come into contact with the flat surface of the pins 21F;
- a second phase of fast movement of the slide 23, which would start at the moment of the release of the teeth 23E with respect to the pins 21F, in the above described way, by virtue of the movement of the shaft 3 and the slider 26 associated with it; the greater speed of said phase would be determined by the action of the spring 24, since in such a moment the shrinking of the thermally expansible material would be already completed and the shaft 3 would be already in its rest position.

It is then clear that, by means of a suitable dimensioning of the above components (foils 23D, teeth 23E, reliefs 23F, pins 21F, slider 26) and the provision of a plurality of teeth 23E, reliefs 23F and pins 21F, several distinct phase of movement could be obtained, substantially in a stepped fashion during a same return movement of the slide.

A further possible variant relates to the type of embodiment of the thermo-actuator 7, which could be of the type using, as a thermally expansible material, a liquid (for instance a particular type of alcohol or solvent), instead of a wax.

It has also to be noticed that the actuation apparatus 1 could be of the traction type, instead of the thrust or push type, as in the example given in the figures, by suitably changing the orientation of the previously described components and/or their direction of movement.

In the given example, the slider 26 is integral with the cover 25, which is therefore movable with the shaft of the actuation apparatus 1; as already said, however, it is clear that the cover 21 could be instead fixed to the body 21, in which case the slider 26 will be clearly an element distinct from the same cover, and movable independently from it.

Concerning the case of a movable cover 25, it is mentioned that the body 21 or the slide 23 could have small upturned pegs, inserted into suitable slots defined in the cover 25, the sliding of said slots with respect to said pegs allowing to guide with precision the movement of the cover.

It is then clear that the sensor 22, when necessary, could be constituted by any suitable sensor of the position of the slide 23, such as a sensor of the inductive type or of the Hall effect type, and not necessarily a micro-switch.

Instead of a spring 24 loaded in compression and working between the slide 23 and the body 21, a spring, or other resilient element, could be provided, loaded in tension and working between the actuation apparatus 1 and the slide 23.

The reliefs 23F, in addition, must not be necessarily an integral part of the foils 23D; for example, they could be formed by independent flexible elements, for instance made integral with the wall of the body 21, and capable of being moved by the slider 26 in the sense of bending or stretching apart the foils 23D.

It is also clear that the elements capable of bending and the fixed ones, for realizing the hooking/release of the slide 23, might have an inverse arrangement with respect to the one being indicated in the figures, i.e. the flexible hooking components could be integral with the body 21, and the fixed hooking components could be integral with the slide 23.

It is also clear that the pins 21F must not be necessarily a part of the body 21, since the latter, whenever necessary, might be not equipped with a bottom wall.

With reference to the use of the device 20 in the construction of a system for blocking in a determined position the drum of a machine for washing and/or drying laundry, it is finally cited the possibility of associating damper elements, such as elastic or resilient washers, to the flanges 21A and/or the holes 21B for the relevant fixing means, in order to reduce the mechanical and operating stresses on the body 21.

Finally, as said, the invention is susceptible of use also in connection with actuators being different with respect to the thermal ones, such as for instance electric motors and/or gear-reducers, which actuate a cam.

What is claimed is:

1. Actuation device, comprising:

an actuator (1) having a movable actuation element (3,8);

at least a transmission element (23) being capable of moving from a respective first operating condition to a respective second operating condition under the action of said actuation element (3,8);

characterized in that actuating means (21F,23D,24,26) are provided, which are made operative by said actuation element (3,8) during a linear displacement of the latter, for inducing to said transmission element (23) a linear movement which occurs in the same direction of said linear displacement and at least in part with a speed being higher than the speed of said linear displacement of said actuation element (3,8).

2. Actuation device, according to claim 1, characterized in that said actuating means (21F,23D,24,26) comprise hooking means (21F,23D) for retaining said transmission element (23) in the respective second operating condition, during at least a first part of said displacement of said actuation element (3,8).

3. Actuation device, according to claim 2, characterized in that said hooking means (21F,23D) are capable of being released during at least a second part of said displacement of said actuation element (3,8).

4. Actuation device, according to claim 2, characterized in that said actuating means (21F,23D,24,26) comprise release means (23F,26) which are made operative by said actuation element (3,8), for releasing said hooking means (21F,23D)

during at least a second part of said displacement of said actuation element (3,8).

5. Actuation device, according to claim 4, characterized in that said release means (23F,26) comprise strikers (23F), for inducing a second bending of said first hooking means (21F,23D) with respect to said second hooking means (21F).

6. Actuation device, according to claim 5, characterized in that the amplitude of said second bending is capable of determining the uncoupling of said first hooking means (21F,23D) with respect to said second hooking means (21F).

7. Actuation device, according to claim 5, characterized in that said movable element (26) is capable of operating strikers (23F) in order to produce said second bending, during said displacement of said actuation element (3,8).

8. Actuation device, according to claim 5, characterized in that said strikers (23F) are associated and/or made integral with said first hooking means (23D).

9. Actuation device, according to claim 4, characterized in that said release means (23F,26) comprise a movable element (26) which is associated with said actuation element (3,8).

10. Actuation device, according to claim 9, characterized in that said movable element performs a useful stroke being greater than the stroke of said first hooking means (23D).

11. Actuation device, according to claim 2, characterized in that said hooking means (21F,23D) comprise first hooking means (23D) and second hooking means (21F) being capable of mutual coupling during the movement of said transmission element (23) from the respective first operating condition to the respective second operating condition.

12. Actuation device, according to claim 11, characterized in that said first hooking means (23D) are flexible with respect to said second hooking means (21F).

13. Actuation device, according to claim 11, characterized in that said first hooking means (23D) are associated with said transmission element (23) and movable in function of the movement of the latter with respect to said second hooking means (21F).

14. Actuation device, according to claim 11, characterized in that said second hooking means (21F) are in a position being fixed with respect to said transmission element (23).

15. Actuation device, according to claim 11, characterized in that a first bending of said first hooking means (23D) is induced by the sliding of a first surface of said first hooking means (23D) onto a first surface of said second hooking means (21F), in order to realize their mutual coupling.

16. Actuation device, according to claim 11, characterized in that said movement of said transmission element (23) from the respective second operating condition towards the respective first operating condition comprises at least a movement phase which is realized substantially at said second speed and which starts following the mutual uncoupling between said first and second hooking means (21F, 23D), being possibly preceded by a movement phase which is realized substantially at said first speed and which ends following the mutual coupling between said first and second hooking means (21F,23D).

17. Actuation device, according to claim 15, characterized in that said first bending ends substantially at the overcoming of the sliding of said first surface of said first hooking means (23D) onto said first surface of said second hooking means (21F).

18. Actuation device, according to claim 17, characterized in that, at the end of the sliding of said first surface of said first hooking means (23D) onto said first surface of said second hooking means (21F), said first hooking means are capable of returning towards the respective original position, where a second surface of said first hooking means (23D) results in cooperating with a second surface of said second hooking means (21F).

19. Actuation device, according to claim 5, characterized in that said actuating means comprise a slider, said slider (26) comprising at least a projection (26A) for operating on said strikers (23F).

20. Actuation device, according to claim 2, characterized in that said hooking means (21F,23D) comprise one or more elastic foils (23D), in particular being integral with said transmission element.

21. Actuation device, according to claim 20, characterized in that said elastic foils (23D) have hooking teeth (23E).

22. Actuation device, according to claim 20, characterized in that said elastic foils (23D) comprise strikers (23F).

23. Actuation device, according to claim 2, characterized in that said hooking means (21F,23D) comprise one or more pins (21F) which are in a fixed position with respect to said actuation element (3,8) and/or said transmission element.

24. Actuation device, according to claim 1, characterized in that said actuating means (21F,23D,24,26) comprise elastic or resilient means (24), which are loaded by means of said transmission element (23), during the movement of the latter from the respective first operating condition to the respective second operating condition.

25. Actuation device, according to claim 24, characterized in that the energy of said elastic means (24), which is capable to give said transmission element (23) said movement of higher speed, is made operative following the release of hooking means (21F,23D).

26. Actuation device, according to claim 1, characterized in that transmission means are provided, being connected to said transmission element (23), for carrying out a remote actuation.

27. Actuation device, according to claim 1, characterized in that said actuating means (21F,23D,24,26) are configured for obtaining a plurality of distinct movement phases for said transmission element (23), substantially occurring in a stepped fashion, during said movement of said transmission element (23) from the respective second operating condition towards the respective first operating condition.

28. Actuation device, according to claim 1, characterized in that said transmission element comprises a sliding element (23).

29. Actuation device, according to claim 1, characterized in that said actuating means (21F,23D,24,26) comprise a slider (26).

30. Actuation device, according to claim 1, characterized in that a main body (21) is provided, within which said transmission element (23) is capable of linear movement.

31. Actuation device, according to claim 1, characterized in that said actuator (1) is of the electric type.

32. Actuation device, according to claim 1, characterized in that said actuator (1) is of the thermal or electro-thermal type.

33. Actuation device, according to claim 32, characterized in that said actuator (1) comprises:

a container (7) for a thermally expansible material (C);

a pushing element or small piston (8), one end of which is arranged within said container (7) and dipped into said thermally expansible material (C), the other end of said pushing element (8) protruding out of said container (7);

means for heating (10) said container (7), in order to cause an expansion of said thermally expansible material (C).

34. Actuation device, according to claim 1, characterized in that sensor means (22) are provided, of the operating condition and/or the position of said transmission element (23).

35. Use of the device according to claim 1, in a system for blocking in a determined position the drum of a machine for washing and/or drying laundry.

36. Actuation device, comprising:

an actuator (1) having a movable actuation element (3,8);

at least a transmission element (23) being capable of linear movement from a respective first operating condition to a respective second operating condition under the action of said actuation element (3,8);

characterized in that actuating means (21F,23D,24,26) are provided, which are made operative by said actuation element (3,8) during at least a part of an operating period of the latter, for inducing to said transmission element (23) a linear movement which occurs in the same direction of the linear movement of said actuation element and is delayed with respect to the displacement of said actuation element (3,8).

37. System for blocking in a determined position the drum of a machine for washing and/or drying laundry, comprising:

an actuator (1) having a movable actuation element (3,8)

at least a blocking element (23) being capable of displacement, under the action of said actuation element (3,8), from an operating condition where said drum is blocked in a determined position to a second operating condition where said drum is free to move, characterized in that actuating means (21F,23D,24,26) are provided, which are made operative by said actuation element (3,8) during a displacement of the latter, for inducing to said blocking element (23) a movement which occurs at least in part with a speed being higher than the speed of said displacement of said actuation element (3,8).

38. Blocking system, according to claim 37, characterized in that said blocking element (23) has a portion (23A) capable of cooperating with an element (28) which transmits a motion to said drum.

39. Blocking system, according to claim 37, characterized in that sensor means (22) are provided, which are actuated by said blocking element (23) for controlling the operation of an electric device which assures the closure of a door of the machine.

40. Blocking system, according to claim 37, characterized in that sensor means (22) are provided, which are actuated by said blocking element (23) for controlling the operation of a motor which produces the motion of said drum.

41. Blocking system, according to claim 37, characterized in that transmission means are connected said blocking element (23), for controlling the operation of a mechanical device which is provided for assuring the closure of a door of the machine.

42. Actuation device, comprising:

an actuator having a movable actuation element;

at least a transmission element being capable of moving from a respective first operating condition to a respective second operating condition under the action of said actuation element;

wherein actuating means are provided, which are made operative by said actuation element during a displacement of the latter, for inducing to said transmission element a movement which occurs at least in part with a speed being higher than the speed of said displacement of said actuation element, said actuating means comprising hooking means for retaining said transmission element in the respective second operating condition, during at least a first part of said displacement of said actuation element.

43. Actuation device, according to claim 42, wherein said hooking means are capable of being released during at least a second part of said displacement of said actuation element.

44. Actuation device, according to claim 42, wherein said actuating means comprise elastic or resilient means, which are loaded by means of said transmission element, during the movement of the latter from the respective first operating condition to the respective second operating condition.

45. Actuation device, according to claim 42, wherein said hooking means comprise first hooking means and second hooking means being capable of mutual coupling during the movement of said transmission element from the respective first operating condition to the respective second operating condition.

46. Actuation device, according to claim 45, wherein said movement of said transmission element from the respective second operating condition towards the respective first operating condition comprises at least a movement phase which is realized substantially at said second speed and which starts following the mutual uncoupling between said first and second hooking means, being possibly preceded by a movement phase which is realized substantially at said first speed and which ends following the mutual coupling between said first and second hooking means.

* * * * *